US011814756B2

(12) United States Patent
Myogi et al.

(10) Patent No.: US 11,814,756 B2
(45) Date of Patent: Nov. 14, 2023

(54) SELVAGE YARN SHEDDING APPARATUS OF LOOM

(71) Applicant: TSUDAKOMA KOGYO KABUSHIKI KAISHA, Ishikawa-ken (JP)

(72) Inventors: Keiichi Myogi, Ishikawa-ken (JP); Hiroaki Hasegawa, Ishikawa-ken (JP); Naoto Nohara, Ishikawa-ken (JP)

(73) Assignee: TSUDAKOMA KOGYO KABUSHIKI KAISHA, Ishikawa-Ken (JP)

( * ) Notice: Subject to any disclaimer, the term of this patent is extended or adjusted under 35 U.S.C. 154(b) by 32 days.

(21) Appl. No.: 17/728,578

(22) Filed: Apr. 25, 2022

(65) Prior Publication Data

US 2022/0356607 A1 Nov. 10, 2022

(30) Foreign Application Priority Data

May 10, 2021 (JP) ..... 2021-079451

(51) Int. Cl.
*D03C 13/00* (2006.01)
*D03C 11/00* (2006.01)

(52) U.S. Cl.
CPC ..... *D03C 13/02* (2013.01)

(58) Field of Classification Search
CPC ..... D03C 13/02; D03C 11/00; D03C 5/00; D03C 13/025
See application file for complete search history.

(56) References Cited

U.S. PATENT DOCUMENTS 2,906,296 A * 9/1959 Ancet ..... D03D 47/48 26/11
3,426,807 A * 2/1969 Pfarrwaller ..... D03D 47/40 139/294

(Continued)

FOREIGN PATENT DOCUMENTS

| | | |
|---|---|---|
| EP | 1731640 B1 | 8/2011 |
| JP | 2004-300637 A | 10/2004 |
| JP | 2007-107128 A | 4/2007 |

OTHER PUBLICATIONS

Sep. 29, 2022, European Search Report issued for related EP Application No. 22170099.0.

*Primary Examiner* — Robert H Muromoto, Jr.
(74) *Attorney, Agent, or Firm* — Paratus Law Group, PLLC

(57) ABSTRACT

A selvage yarn shedding apparatus of a loom including two support bodies each having carrier rods configured to support a heddle into which a selvage yarn is inserted and a slide guide having both end portions to which the carrier rods are attached; a drive motor configured to drive in forward-reverse rotations; a support frame including a guide member; and a motion conversion mechanism configured to convert rotation of an output shaft of a drive motor into reciprocating motion in upper-lower direction of each support body. Each of the support bodies includes a connecting part including an extension portion provided above the carrier rod and extending from the slide guide in a longitudinal direction of the carrier rod toward a side where the heddle exists, where the connecting part is configured to connect the slide guide and the motion conversion mechanism each other at the extension portion.

4 Claims, 4 Drawing Sheets

(56) References Cited

U.S. PATENT DOCUMENTS

| | | | | | |
|---|---|---|---|---|---|
| 3,952,778 | A * | 4/1976 | Volpe | D03C 7/06 | 139/54 |
| 4,066,105 | A * | 1/1978 | Heinrich | D03C 7/06 | 139/54 |
| 4,299,257 | A * | 11/1981 | Kinoshita | D03C 7/06 | 139/54 |
| 4,614,210 | A * | 9/1986 | Debaes | D03C 7/06 | 139/54 |
| 5,123,454 | A * | 6/1992 | Debaes | D03C 7/06 | 139/54 |
| 5,141,031 | A * | 8/1992 | Baurmeister | F28F 21/062 | 139/420 A |
| 5,803,133 | A * | 9/1998 | Slosse | D03C 11/00 | 139/54 |
| 5,996,647 | A * | 12/1999 | Krumm | D03C 7/04 | 139/54 |
| 6,293,315 | B1 * | 9/2001 | Froment | D03C 3/205 | 139/55.1 |
| 10,988,867 | B2 * | 4/2021 | Bruynoghe | D03C 3/18 | |
| 11,649,573 | B2 * | 5/2023 | Myogi | D03C 9/0608 | 139/93 |
| 2015/0059914 | A1 * | 3/2015 | Shimazaki | D03C 7/00 | 139/50 |
| 2019/0368081 | A1 * | 12/2019 | Bruynoghe | D03C 3/18 | |

* cited by examiner

SELVAGE YARN SHEDDING APPARATUS OF LOOM

CROSS-REFERENCE TO RELATED APPLICATION(S)

This application is based on and claims priority under 35 USC 119 from Japanese Patent Application No. 2021-079451 filed on May 10, 2021, the contents of which are incorporated herein by reference.

TECHNICAL FIELD

The present invention relates to a selvage yarn shedding apparatus of a loom including two support bodies each having carrier rods configured to support a heddle into which a selvage yarn is inserted and a slide guide having both end portions to which the carrier rods are attached; a drive motor configured to drive in forward and reverse rotations; a support frame fixed to a loom frame and comprising a guide member configured to guide displacement of the slide guides in an upper and lower direction, the drive motor being attached to the support frame; and a motion conversion mechanism configured to connect an output shaft of the drive motor and both the support bodies each other and to convert rotation of the output shaft into reciprocating motion in the upper and lower direction of each support body.

BACKGROUND ART

For example, PTL 1 discloses a selvage yarn shedding apparatus of a loom as described above. In the selvage yarn shedding apparatus disclosed in PTL 1, an upper frame and a lower frame as the carrier rods are attached to both end portions of a slide body as the slide guide, and a plurality of heddles into which selvage yarns are inserted is supported by the upper and lower carrier rods. Note that, an assembly of the slide guide and the carrier rods is provided as one set of two in the selvage yarn shedding apparatus, and each assembly corresponds to the support body described above.

Further, the selvage yarn shedding apparatus includes a guide part (guide member) provided on the loom so as to extend in an upper and lower direction in a form of being supported by an attaching plate attached to the loom frame. Each support body is provided so that displacement in the upper and lower direction is guided by the guide member on the slide guide (slide body). Further, the selvage yarn shedding apparatus includes a drive motor attached to the attaching plate, and is configured so that an output shaft of the drive motor and each support body are connected via a motion conversion mechanism configured to convert rotation of the output shaft into reciprocating motion in the upper and lower direction of the support body. Therefore, in the selvage yarn shedding apparatus, the drive motor is driven in the forward and reverse rotations, so that both the support bodies are reciprocally driven so as to be displaced in opposite directions in the upper and lower direction. Each support body is reciprocally driven in this way, so that the selvage yarns inserted in the heddles supported by each support body are displaced in the upper and lower direction and the selvage yarns are caused to perform shedding motion.

CITATION LIST

Patent Literature

PTL 1: JP2007-107128A

In the meantime, in the selvage yarn shedding apparatus as described above, the heddle into which the selvage yarn is inserted is supported at a position spaced from the slide guide in the longitudinal direction of the carrier rod on each support body. Further, when each support body is displaced to one side in the upper and lower direction so as to cause the selvage yarn to perform the shedding motion as described above, the heddle displaces the selvage yarn in the corresponding direction. At this time, the tension of the selvage yarn becomes a resistance against the displacement, so that a load due to the tension of the selvage yarn acts on the carrier rod supporting the heddle in an opposite direction to the direction in which the support body is displaced. Thereby, a moment due to the load acts on the slide guide to which the carrier rod is attached.

Note that, the displacement in the upper and lower direction of each support body is performed in such a shape that the slide guide is guided by the guide member and the slide guide slides with respect to the guide member, as described above. However, when the above-described moment acts on the slide guide, the moment acts to press the slide guide against the guide member, so that a sliding resistance at the time when the slide guide is displaced increases.

For this reason, there are concerns that the slide guide and the guide member will be worn at an early stage and the support body and the support frame will be damaged. Further, since a large sliding resistance acts on the support body (slide guide) at the time of displacement as described above, the drive motor for reciprocally driving the support body is made to have a large capacity so as to cope with the sliding resistance, in some case. In this case, the apparatus cost increases.

SUMMARY

Therefore, an object of the present invention is to provide a selvage yarn shedding apparatus of a loom capable of reducing a sliding resistance as much as possible, which causes the above-described problems, associated with displacement of the support body.

In order to achieve the above object, the present invention has a preamble of the selvage yarn shedding apparatus of a loom as described above, and is characterized in that each of the support bodies includes a connecting part including an extension portion provided above the carrier rod and extending from the slide guide in a longitudinal direction of the carrier rod toward a side where the heddle exists, where the connecting part is configured to connect the slide guide and the motion conversion mechanism each other at the extension portion. Note that, the 'selvage yarn' referred to in the present invention indicates a yarn for forming a selvage portion of a woven fabric or a yarn for forming a trimmed selvage.

In addition, in the present invention, each connecting part may be connected to the motion conversion mechanism within an existence range of the heddle in the longitudinal direction. Further, each connecting part may be formed as a separate body from the slide guide and may be detachably attached to the slide guide.

According to the selvage yarn shedding apparatus of the loom according to the present invention, the connecting part configured to connect the slide guide and the motion conversion mechanism each other is formed to include the extension portion extending from the slide guide in the longitudinal direction of the carrier rod above the carrier rod. In addition, the selvage yarn shedding apparatus is configured such that the slide guide of each support body and the motion conversion mechanism are connected by the connecting part on the side where the heddle exists in the longitudinal direction. That is, the selvage yarn shedding apparatus is configured so that each slide guide and the motion conversion mechanism are connected each other at a position above the carrier rod and on the side where the heddle exists in the longitudinal direction with respect to the guide part. Thereby, the sliding resistance associated with the displacement of the support body as described above is reduced as much as possible.

More specifically, when displacing each support body to one side in the upper and lower direction, as described above, a drive force of the drive motor acts on the connecting part connecting the slide guide and the motion conversion mechanism in a direction of displacing the support body, via the motion conversion mechanism. In this case, since the slide guide and the motion conversion mechanism are connected each other at the position as described above, the drive force acts on the slide guide at a position spaced from the guide part in the longitudinal direction. Thereby, a moment due to the drive force acts on the slide guide. Note that, the drive force acts in an opposite direction to a direction in which the load due to the tension of the selvage yarn acts. Therefore, the moment due to the drive force acts on the slide guide in the opposite direction to the moment due to the load.

Thereby, the moment acting on the slide guide becomes smaller as a whole, so that the sliding resistance associated with the displacement of the support body described above is also reduced as much as possible. As a result, the slide guide and the guide member are prevented from being worn at an early stage, and the apparatus cost can be reduced by using a drive motor having a small capacity.

Further, by the configuration where the connecting part and the motion conversion mechanism are connected each other within the existence range of the heddle in the longitudinal direction, the reduction in sliding resistance described above is implemented more effectively, as compared to a case where the connecting part and the motion conversion mechanism are connected outside the existence range of the heddle in the longitudinal direction.

Further, each connecting part is configured to be detachably attached to the slide guide. Therefore, even when a weaving condition and the like are changed, the connecting part, which is connected to the motion conversion mechanism at an optimal position corresponding to the changed weaving conditions and the like, can be adopted, and the reduction in sliding resistance described above is implemented more efficiently.

DESCRIPTION OF EMBODIMENTS

Figure 1:
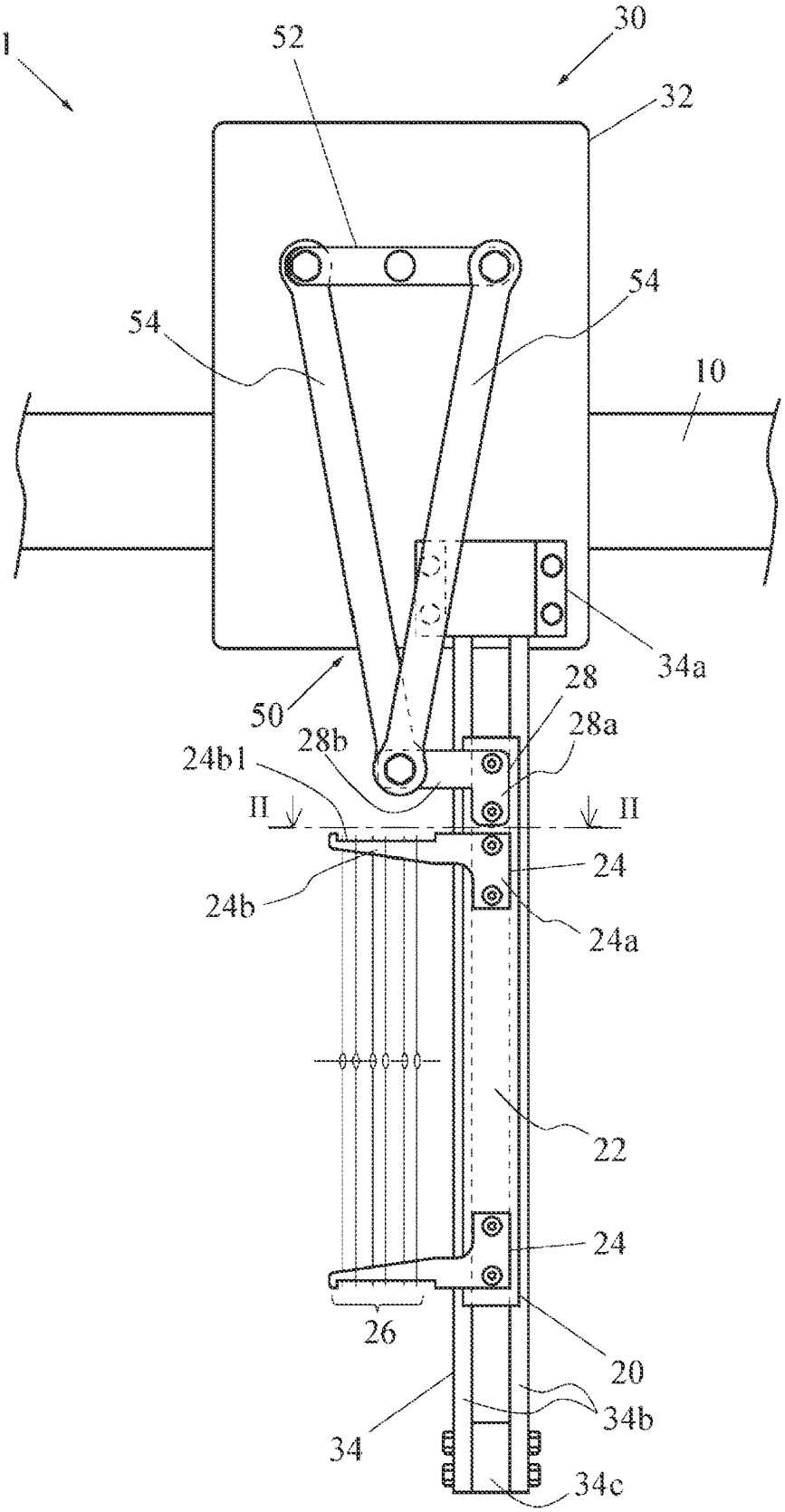
FIG. 1 is a rear view of a selvage yarn shedding apparatus of a loom according to one embodiment of the present invention.
Figure 2:
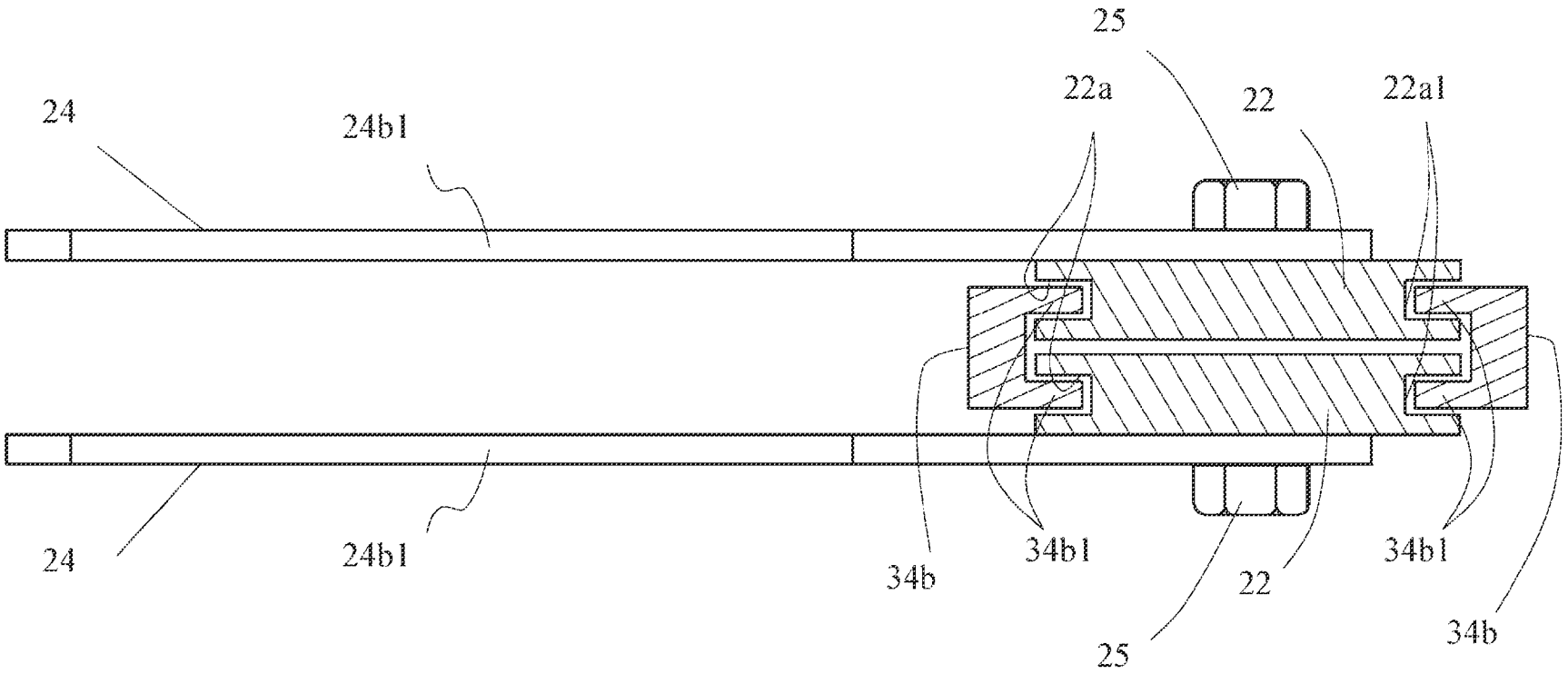
FIG. 2 is a sectional view taken along a II-II line in FIG. 1.
Figure 3:
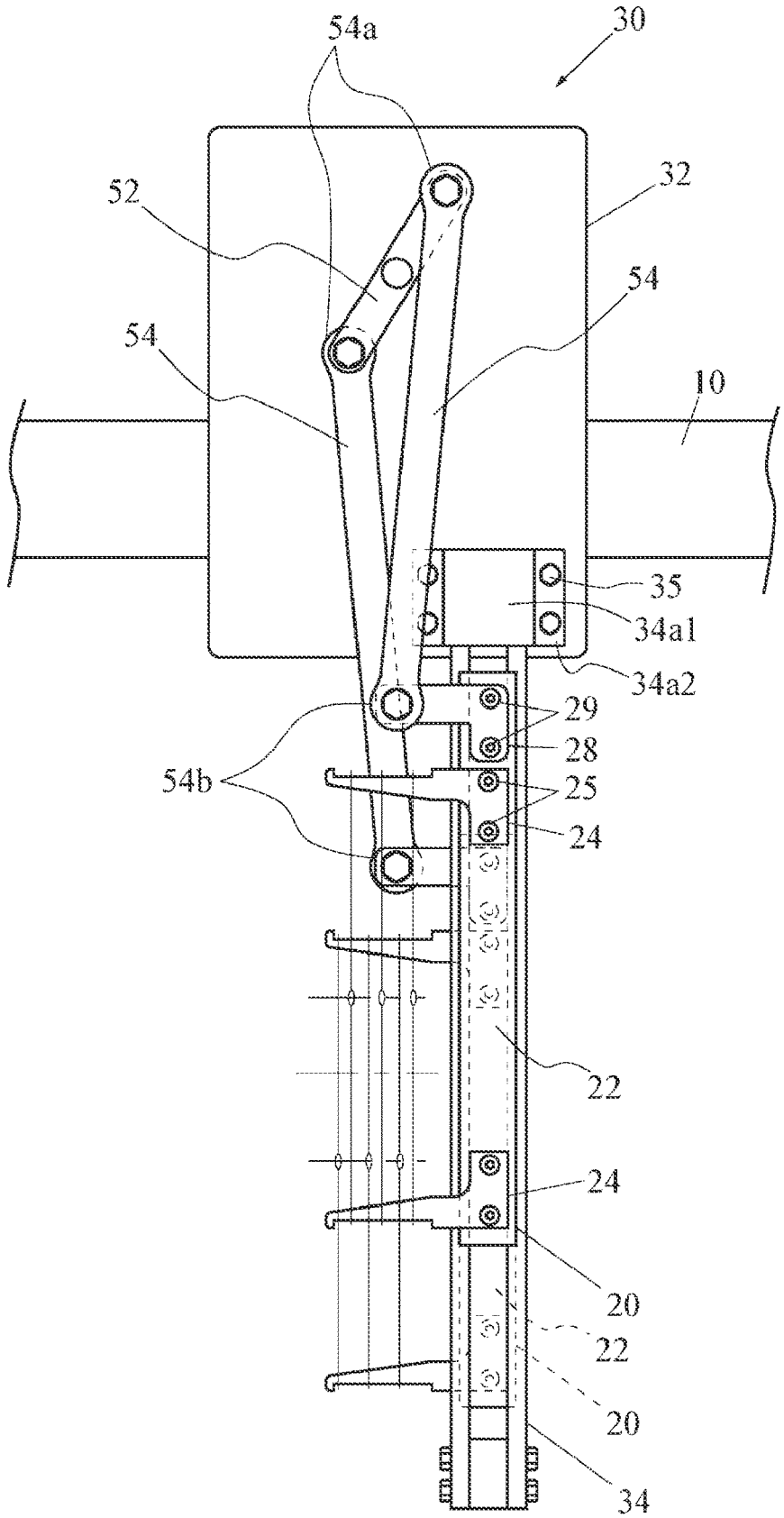
FIG. 3 is a rear view showing an operation of the selvage yarn shedding apparatus.
Figure 4:
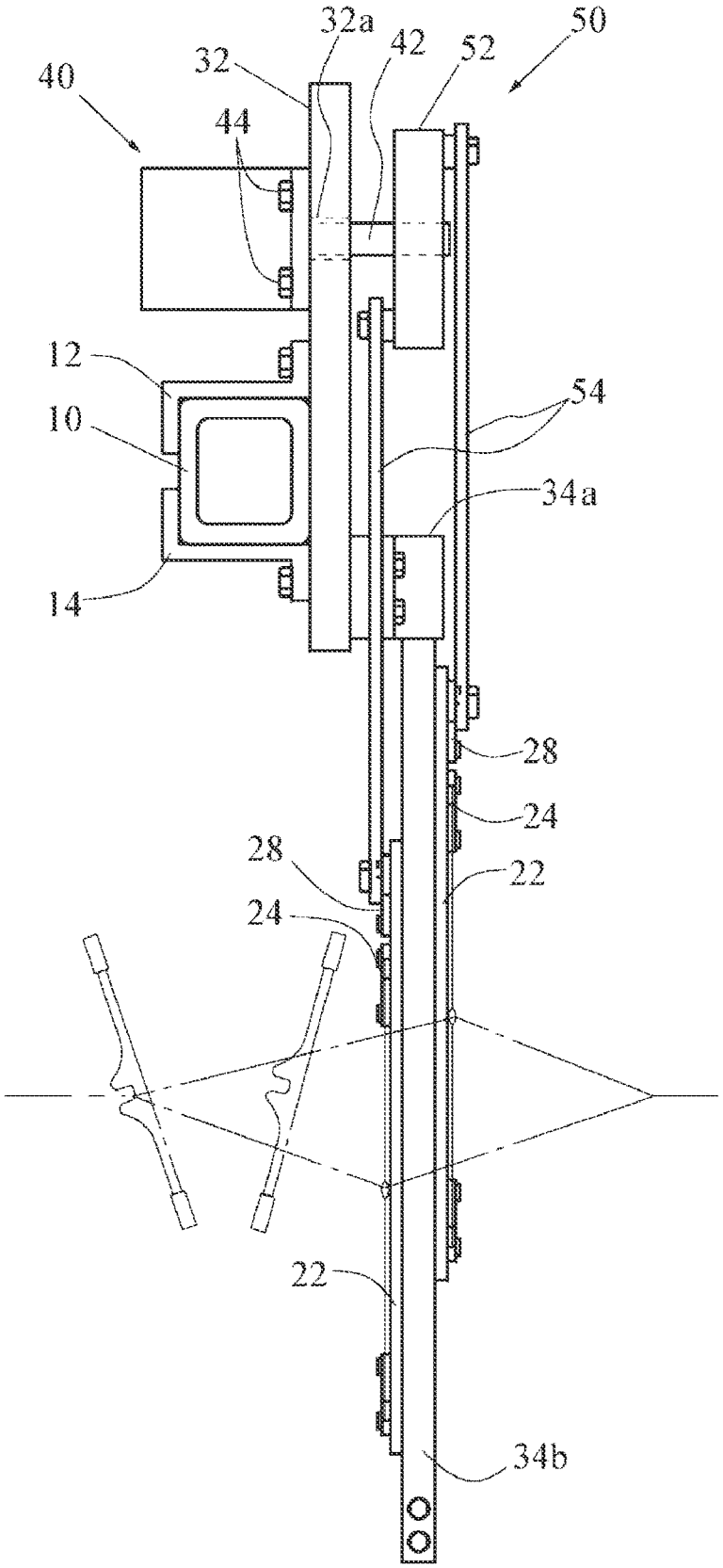
FIG. 4 is a side view of FIG. 3.

Hereinafter, one embodiment (embodiment) of a selvage yarn shedding apparatus of a loom to which the present invention is applied will be described with reference to FIGS. 1 to 4. Note that, the selvage yarn shedding apparatus is provided at both ends-side of a heddle frame for a warp shed (not shown) at a position on a front side of a loom (a winding device-side (not shown)) with respect to the heddle frame.

A selvage yarn shedding apparatus 1 includes two support bodies 20 and 20 configured to support a plurality of heddles 26 into which selvage yarns are inserted, a support frame 30 attached to a loom frame and configured to guide displacement of the support bodies 20, a drive motor 40 attached to the support frame 30, and a motion conversion mechanism 50 configured to connect each support body 20 and the drive motor 40.

In addition, each support body 20 includes a carrier rod 24 configured to support the heddles 26 and a slide guide 22 to which the carrier rod 24 is attached. More specifically, the slide guide 22 is a plate-shaped member, and is formed in a rectangular shape where a dimension in a long side direction of an end face thereof is sufficiently longer than a dimension in a short side direction, when seen in a plate thickness direction. Further, the slide guide 22 has a pair of groove portions 22*a* and 22*a* formed to open to both side surfaces in the short side direction and to extend in the long side direction.

The carrier rod 24 is a plate-shaped member, and is formed in a substantial L-shape, when seen in a plate thickness direction. The carrier rod 24 is formed so that a width dimension of a portion (one end portion) 24*a* on one end-side with respect to the L-shaped bent portion (bent portion) is slightly smaller than the dimension in the short side direction of the slide guide 22. In addition, the carrier rod 24 is attached at one end portion 24*a* to the end surface of the slide guide 22 by a screw member 25. Further, in each support body 20, the two carrier rods 24 and 24 are attached to the slide guide 22 with being spaced from each other in the long side direction.

In the meantime, each carrier rod 24 is attached in such a form that a portion (other end portion) 24*b* on the other end-side with respect to the bent portion of each carrier rod 24 extends parallel to the short side direction of the slide guide 22 and both carrier rods 24 and 24 are symmetrical in the long side direction. The two carrier rods 24 and 24 are attached to the slide guide 22 in this way, so that the other end portion 24*b* of each carrier rod 24 becomes a portion that supports the heddles 26, in each support body 20. Further, the respective carrier rods 24 are attached in such a form that a distance between the carrier rods 24 and 24 becomes a size corresponding to a length dimension of the heddle 26.

Note that, the other end portion 24*b* of each carrier rod 24 is formed with a concave portion 24*b*1 for preventing the heddle 26 from coming off from the other end portion 24*b*. The concave portion 24*b*1 is formed in such a shape that, when each carrier rod 24 in the attached state described above is seen in the plate thickness direction, a portion on a side of the other end portion 24*b*, which does not face the other carrier rod 24, is concave. In addition, each heddle 26 is supported by the carrier rods 24 (the other end portions 24*b*) in a form of being hooked in the concave portions 24*b*1. Thereby, each heddle 26 is in a state in which a position in an extension direction of the other end portion 24*b* (a longitudinal direction of the carrier rod 24) is regulated by the concave portions 24*b*1. Therefore, the concave portion 24*b*1 is a portion that supports the heddle 26 at the other end portion 24*b*, and an existence range of the concave portion 24*b*1 in the extension direction of the other end portion 24*b* (longitudinal direction of the carrier rod 24) is an existence range of the heddle 26 in the selvage yarn shedding apparatus 1.

The support frame 30 includes a guide part 34 that is a part configured to guide displacement of the support bodies 20 (slide guides 22), and a base part 32 configured to support the guide part 34. The support frame 30 is attached at the base part 32 to a stay 10, which is bridged between left and right side frames (not show) of the loom frame and extends in a weaving width direction, via attaching brackets 12 and 14. Note that, the base part 32 is formed as a plate-shaped member. The base part 32 is attached to the stay 10 in such a form that both end faces in a plate thickness direction of the base part 32 are parallel to the upper and lower direction and the weaving width direction.

In addition, the guide part 34 has two rail members 34*b* and 34*b* configured to guide displacement of both support bodies 20 and 20 and an attaching member 34*a* for attaching both the rail members 34*b* and 34*b* to the base part 32. That is, in the present embodiment, the support frame 30 is configured to guide displacement of the two support bodies 20 and 20 by one set of a rail pair consisting of the two rail members 34*b* and 34*b*.

Note that, the attaching member 34*a* is formed to include a support part 34*a*1 to which both the rail members 34*b* and 34*b* are fixed, and an attaching part 34*a*2 for attaching the support part 34*a*1 to the base part 32. In addition, the support part 34*a*1 is formed in a block shape having a substantially cuboid shape where both side surfaces and upper and lower surfaces form a rectangular shape. Further, the attaching part 34*a*2 is formed in two in a form of protruding from each of both the side surfaces of the support part 34*a*1 in a width direction (long side direction of the upper and lower surfaces) of the support part 34*a*1. However, the attaching pails 34*a*2 each have a plate shape, and are each provided so that a plate thickness direction coincides with a thickness direction of the support part 34*a*1 (short side direction of the upper and lower surfaces).

The attaching member 34*a* is attached to the base part 32 by screwing a screw member 35 inserted in the attaching part 34*a*2 into the base part 32. At this time, the attaching member 34*a* is attached to the base part 32 on an end face (rear side surface) opposite to an end face (front side surface), which is the stay 10-side at the time of attachment to the stay 10 as described above, of both the end faces of the base part 32.

Each rail member 34*b* is a long and substantially prismatic member whose dimension in a longitudinal direction is longer than the dimension in the long side direction of the slide guide 22 of the support body 20. Both the rail members 34*b* and 34*b* are fixed at one end portions thereof to the support part 34*a*1 of the attaching member 34*a* so as to extend parallel to the side surfaces from a lower surface of the attaching member 34*a* in a state of being attached to the base part 32. Note that, both the rail members 34*b* and 34*b* are fixed to the support part 34*a*1 so that both the rail members 34*b* and 34*b* are spaced from each other in the width direction of the support part 34*a*1 and their positions in the thickness direction are substantially the same (face each other). Further, both the rail members 34*b* and 34*b* are connected each other at the other end portions thereof by a plate-shaped connecting member 34*c* so that an interval therebetween in the facing state is maintained.

Further, both the rail members 34*b* and 34*b* each have a rail 34*b*1 on a surface (facing surface) on the facing side thereof for guiding displacement in the upper and lower direction of the support body 20 (slide guide 22). The rail 34*b*1 is formed to protrude from the facing surface in the width direction of the support part 34*a*1 and to extend in the longitudinal direction of the rail member 34*b*. Further, in the present embodiment, as described above, the support frame 30 is configured to guide displacement of the two support bodies by the two rail members 34*b* and 34*b* (one set of a rail pair). Therefore, the rail 34*b*1 is formed in two to be spaced from each other in the thickness direction in a state where the rail members 34*b* are attached to the attaching member 34*a* (support part 34*a*1).

Note that, each rail 34*b*1 is formed so that a thickness dimension thereof is slightly smaller than a groove width of the groove portion 22*a* of the slide guide 22 of the support body 20. Further, both the rail members 34*b* and 34*b* are formed so that an interval between the facing rails 34*b*1 and 34*b*1 in the width direction is slightly larger than a dimension between bottom surfaces 22*a*1 and 22*a*1 of both the groove portions 22*a* and 22*a* in each slide guide 22. Thereby, the support frame 30 is configured so that the slide guides 22 can be received between the rails 34*b*1 and 34*b*1 of both the rail members 34*b* and 34*b* facing each other in the width direction in the guide part 34.

In the selvage yarn shedding apparatus 1, both the support bodies 20 and 20 are in a state where the slide guides 22 and 22 are received between the pair of rail members 34*b* and 34*b* of the support frame 30. Thereby, both the support bodies 20 and 20 are provided in such a form that displacement in the upper and lower direction is guided along the rails 34*b*1 and 34*b*1. Further, the plurality of heddles 26 into which selvage yarns are inserted is supported on each of the pair of carrier rods 24 and 24 of each support body 20.

In addition, the drive motor 40 is attached, by a screw member 44, to the base part 32 of the support frame 30 fixed to the stay 10 of the loom frame as described above. Note that, the drive motor 40 is attached at a position spaced above the stay 10 on the front side surface of the base part 32. In addition, the base part 32 is formed with a through-hole 32*a* that allows an output shaft 42 of the drive motor 40 to penetrate at the attaching position of the drive motor 40. Thereby, in a state where the drive motor 40 is attached to the base part 32, the output shaft 42 is inserted in the through-hole 32*a*, and a tip end portion of the output shaft 42 protrudes from the base part 32.

Further, the motion conversion mechanism 50 includes a swing arm 52 attached to the output shaft 42 of the drive motor 40, and a pair of connecting rods 54 and 54 connected to the swing arm 52 and also connected to both the support bodies 20 and 20. The swing arm 52 is a lever-shaped member, and is fixed to the tip end portion of the output shaft 42 of the drive motor 40 at a central portion in a longitudinal direction thereof, so as not to be relatively rotatable.

In addition, each connecting rod 54 is a lever-shaped member, like the swing arm 52. Each connecting rod 54 is connected at one end portion 54*a* to one of both end portions of the swing arm 52 as being relatively rotatable, and is connected at the other end portion 54*b* to the slide guide 22 of the corresponding support body 20 as being relatively rotatable. Therefore, one support body 20 of the two support bodies 20 and 20 is connected to one end portion of the swing arm 52 fixed to the output shaft 42 of the drive motor 40 by one connecting rod 54, and the other support body 20 is connected to the other end portion of the swing arm 52 by the other connecting rod 54. Thereby, both the support bodies 20 and 20 are connected to the output shaft 42 of the drive motor 40 via the motion conversion mechanism 50.

According to the motion conversion mechanism 50 configured in this way, rotation of the output shaft 42 of the drive motor 40 is converted into reciprocating motion in the upper and lower direction of each support body 20. Specifically, when the output shaft 42 of the drive motor 40 is reciprocally and reversely driven in forward and reverse rotation directions, both connecting points of the swing arm 52 and the respective connecting rods 54 located on both sides with the output shaft 42 being interposed therebetween respectively swing in opposite directions around an axis line of the output shaft 42. Along with this, both the support bodies 20 and 20 connected to the respective connecting rods 54 reciprocally move in the upper and lower direction in a form of being guided by the guide part 34 of the support frame 30, according to directions in which the connecting points swing. Both the support bodies 20 and 20 are displaced upward or downward in this way, so that each heddle 26 supported by the carrier rods 24 is displaced upward or downward and the selvage yarn inserted in each heddle 26 is caused to perform shedding motion.

In the selvage yarn shedding apparatus of the loom as described above, in the present invention, each support body 20 has a connecting part including an extension portion extending from the slide guide 22 in the longitudinal direction toward the heddle 26 above the carrier rod 24 and configured to connect the slide guide 22 and the motion conversion mechanism 50 at the extension portion. The present embodiment is an example where a connecting part 28 and the motion conversion mechanism 50 are connected each other within the existence range of the heddle 26 supported by the carrier rod 24 in the longitudinal direction. Further, the present embodiment is an example where the connecting part 28 is formed as a separate member from the slide guide 22 and the connecting part 28 is detachably attached to the slide guide 22. The support body 20 of the present embodiment is described in detail, as follows.

The connecting part 28 is a plate-shaped member, and is formed in a substantial L-shape, when seen in a plate thickness direction. More specifically, the connecting part 28 is formed in such a shape that an extension direction, from an L-shaped bent portion (bent portion), of a portion (one end portion) 28*a* on one end-side with respect to the bent portion and an extension direction of a portion (other end portion) 28*b* on the other end-side from the bent portion are substantially orthogonal to each other, when seen in the plate thickness direction.

The connecting part 28 is attached to the slide guide 22 at an upper end portion of the end surface to which the pair of carrier rods 24 and 24 is attached. Note that, in each support body 20, the upper carrier rod 24 of the pair of carrier rods 24 and 24 is attached to the slide guide 22 at a position spaced slightly downward from an upper end of the slide guide 22 with respect to the long side direction of the slide guide 22. In addition, the connecting part 28 is attached to the upper end portion (a portion between the upper end and the position where the upper carrier rod 24 is attached) of the slide guide 22.

Further, the connecting part 28 is attached in such a form that the extension direction of one end portion 28*a* coincides with the long side direction of the slide guide 22 and a direction of the other end portion 28*b* with respect to the slide guide 22 is the same as the direction of the other end portion 24*b* of the carrier rod 24. Thereby, the connecting part 28 is in a state where the extension direction of the other end portion 28*b* is parallel to the longitudinal direction of the carrier rod 24 and the other end portion 28*b* is located above the carrier rod 24. Note that, the connecting part 28 is attached to the slide guide 22 by screwing a screw member 29 inserted in one end portion 28*a* of the connecting part 28 into the slide guide 22. The connecting part 28 can be detached from the slide guide 22 by loosening the fastening of the screw member 29.

In addition, a length dimension of the other end portion 28*b* of the connecting part 28 is set so that a tip end portion of the other end portion 28*b* is located at a substantial center in the existence range of the heddle 26 in the longitudinal direction of the carrier rod 24, in the attached state described above. Further, the connecting part 28 attached to the slide guide 22 of each support body 20 is connected at the tip end portion of the other end portion 28*b* to the other end portion 54*b* of the corresponding connecting rod 54 of the motion conversion mechanism 50 as being relatively rotatable. Therefore, each support body 20 is in a state of being connected to the corresponding connecting rod 54 of the motion conversion mechanism 50 on the same side as the side where the other end portion 24*b* of the carrier rod 24 exists with respect to the slide guide 22. In the present embodiment, the other end portion 28*b* of the connecting part 28 corresponds to the extension portion of the connecting part referred to in the present invention.

According to the selvage yarn shedding apparatus 1 of the present embodiment configured as described above, when the drive motor 40 is rotationally driven as described above, a drive force of the drive motor 40 acts on each support body 20 via the motion conversion mechanism 50. Thereby, each support body 20 is displaced upward or downward by the drive force. As each support body 20 is displaced in this way, a load due to tension of the selvage yarn inserted in each heddle 26 acts on the slide guide 22 of each support body 20 via the heddle 26 and the carrier rod 24. Note that, the load acts in a direction opposite to a direction in which the support body 20 is to be displaced (a direction in which the drive force acts). Further, since the heddle 26 is supported by the carrier rod 24 in the above-described manner, the load acts at a position spaced from the slide guide 22 in the longitudinal direction. As a result, a moment due to the selvage yarn tension acts on the slide guide 22 as a rotating force in the direction in which the load acts.

On the other hand, since the slide guide 22 and the motion conversion mechanism 50 are connected each other via the connecting part 28 configured as described above, the drive force acts at a position spaced from the slide guide 22 in the longitudinal direction on the same side as the side where the load acts on the slide guide 22 in the longitudinal direction. Therefore, a moment due to the drive force also acts on the slide guide 22 as a rotating force in the direction in which the drive force acts.

Since the direction in which the drive force acts and the direction in which the load acts are opposite to each other, as described above, the moment due to the drive force and the moment due to the selvage yarn tension act on the slide guide 22 at the same time as rotating forces in opposite directions, and both the moments are canceled each other. Thereby, the moment acting on the slide guide 22 becomes smaller as a whole.

Therefore, according to the selvage yarn shedding apparatus 1, a sliding resistance (between the slide guide 22 of each support body 20 and the rail members 34*b* of the guide part 34) associated with the reciprocating motion of each support body 20 described above is also reduced as much as possible. Therefore, the slide guide 22 and the rail members 34*b* are prevented from being worn at an early stage. Further, the sliding resistance is reduced, so that it becomes possible to use the drive motor 40 having a small capacity, and it is possible to reduce the apparatus cost by adopting such drive motor 40.

Further, in the present embodiment, a connecting position of the slide guide 22 and the motion conversion mechanism 50 (connecting rod 54) is a position within the existing range of the heddle 26 in the longitudinal direction. Thereby, it is possible to more effectively reduce the sliding resistance associated with the reciprocating motion in the upper and lower direction of each support body 20. Specifically, the load due to the tension of the selvage yarn acts in the above-described existence range of the heddle 26 into which the selvage yarn is inserted, with respect to the longitudinal direction of the carrier rod 24. Therefore, by the configuration where the connecting part 28 and the connecting rod 54 of the motion conversion mechanism 50 are connected at the position within the existence range of the heddle 26 in the longitudinal direction, the drive force of the drive motor 40 can be caused to act in the vicinity of the position in the longitudinal direction where the load acts. Thereby, as compared to a selvage yarn shedding apparatus where the connection of the connecting part 28 and the connecting rod 54 are performed outside the existence range of the heddle 26 in the longitudinal direction, the sliding resistance associated with the reciprocating motion of the support body 20 can be reduced more effectively.

Further, in the present embodiment, the connecting part 28 is attached on the slide guide 22 by the screw member 29, and can be attached and detached to and from the slide guide 22 by loosening the fastened state of the screw member 29. Thereby, for example, when the number of selvage yarns to be inserted in the heddles 26 is changed due to a change in weaving conditions, the selvage yarn tension at the time of weaving also changes. Therefore, by adopting the connecting part that is connected to the motion conversion mechanism 50 at an optimal position corresponding to the selvage yarn tension, the sliding resistance associated with the reciprocating motion of the support body 20 can be reduced more efficiently.

In the above, one embodiment (hereinafter, referred to as 'above embodiment') of the selvage yarn shedding apparatus to which the present invention is applied has been described. However, the present invention is not limited to the configuration described in the above embodiment, and can also be implemented by other embodiments (modified embodiments) as described below.

(1) As for the connecting part, in the above embodiment, the connecting part 28 configured to connect the slide guide 22 and the motion conversion mechanism 50 each other is formed in an L-shape, when seen in the plate thickness direction. However, the connecting part in the present invention may be configured to include the extension portion that is connected to the motion conversion mechanism, and is not limited to the L-shape as in the above embodiment, and for example, may also be a T-shape or a cross shape. In any case, the portion extending from the slide guide 22 toward the heddle 26 side in the longitudinal direction is the extension portion. In addition, the connecting part is not limited to one configured to include a portion that is fixed to the slide guide 22, in addition to such extension portion, and may also be configured to include only a portion corresponding to the extension portion and to be fixed to the slide guide at the extension portion.

In addition, as for the extension portion of the connecting part, in the above embodiment, the other end portion 28*b* of the connecting part 28, which is the extension portion, is configured to be connected to the motion conversion mechanism 50 at the position within the existence range of the heddle 26 in the longitudinal direction. Specifically, the length dimension of the other end portion 28*b* of the connecting part 28 is set so that the tip end portion of the other end portion 28*b* is located at the position in the existence range of the heddle 26 in the longitudinal direction, in the state where the connecting part 28 is attached to the slide guide 22. The connecting part 28 is connected to the connecting rod 54 at the tip end portion of the other end portion 28*b*.

However, in the present invention, the connecting position of the connecting part and the motion conversion mechanism 50 is not limited to the tip end portion of the extension portion of the connecting part, and may be a position on the extension portion spaced from the slide guide 22 in the longitudinal direction. That is, the connecting part may be configured to be connected to the motion conversion mechanism 50 at an arbitrary position on the extension portion.

Further, the connecting position may also be a position that is on the extension portion of the connecting part and does not overlap with the existence range of the heddle 26. For example, the extension portion of the connecting part may be formed to have such a space that allows the connection with the motion conversion mechanism 50 at a portion between the existence range of the heddle 26 and the slide guide 22 in the longitudinal direction, and the connecting part may be configured to be connected to the motion conversion mechanism 50 at the portion. Further, the extension portion of the connecting part may be formed to have a length dimension extending to a position beyond the existence range of the heddle 26 in the longitudinal direction, and the connecting part may be configured to be connected to the motion conversion mechanism 50 at a position outside the existence range of the heddle 26.

Further, the connecting part may also be configured so that the connecting position with the motion conversion mechanism 50 can be changed. For example, the extension portion may be formed with a plurality of through-holes for connection to the motion conversion mechanism 50, and the connecting part may be configured to be connected to the motion conversion mechanism 50 in any one of the plurality of through-holes. Further, instead of forming such a plurality of through-holes, the extension portion may be formed with an elongated hole extending in the longitudinal direction, and the connecting part may be configured to be connected to the motion conversion mechanism 50 at an appropriate position within a range of the elongated hole.

Further, in the above embodiment, the connecting part 28 is formed as a separate body from the slide guide 22, and is detachably attached on the slide guide 22. However, the connecting part may also be integrally formed with the slide guide, and for example, may be integrated with the slide guide in a form of being fixed to the slide guide by welding or the like. Note that, when the connecting part is integrated with the slide guide in this way, the slide guide is configured to include the connecting part.

(2) As for the motion conversion mechanism configured to convert the rotation of the output shaft 42 of the drive motor 40 into the reciprocating motion of each support body 20, the motion conversion mechanism 50 of the above embodiment is configured by the swing arm 52 attached to the output shaft 42 of the drive motor 40 and the pair of connecting rods 54 and 54 connected to the swing arm 52 and also connected to both the support bodies 20 and 20. However, in the present invention, the motion conversion mechanism is not limited to such a configuration.

For example, the motion conversion mechanism may adopt a gear train instead of the swing arm. Specifically, the motion conversion mechanism is configured to have a drive gear attached to the output shaft 42 of the drive motor 40 and a pair of driven gears in mesh with the drive gear, as the gear train. In addition, the motion conversion mechanism may also be configured so that each connecting rod connected to the corresponding support body 20 at one end portion is connected at the other end portion to the corresponding driven gear as being relatively rotatable at a position eccentric from a center of the driven gear.

According to such motion conversion mechanism, when the drive motor 40 drives the drive gear in forward and reverse rotations, both the driven gears are rotated accordingly, and both connection points of the driven gears and the connecting rods swing around an axis line of the output shaft 42 of the drive motor 40. Along with this, both the support bodies 20 and 20 connected to the respective connecting rods reciprocally move in the upper and lower direction in a form of being guided by the guide part 34 of the support frame 30, according to directions in which the respective connecting points swing.

(3) As for the support frame including the guide part configured to guide displacement of the support body 20 (slide guide 22), in the above embodiment, the support frame 30 is configured to guide displacement of the two support bodies 20 and 20 by the guide part 34 (one set of a rail pair) constituted by the two rail members 34*b* and 34*b*. However, in the present invention, the support frame may also be configured to guide displacement of each support body 20 by two sets of rail pairs each provided for each support body. That is, the support frame may be configured such that the guide part includes two sets of rail pairs and the two sets of rail pairs guide displacement of the two support bodies 20 and 20.

Note that, in a case where the guide part is constituted by the two sets of rail pairs, positions of the two sets of rail pairs in the longitudinal direction are not limited to the same position and may be different positions. Further, in the case where the guide part is configured in this way, the attaching member for attaching the guide part to the base part 32 may be provided as a member common to the two sets of rail pairs, or may be provided individually for each rail pair.

The present invention is not limited to the above embodiment, and can be variously changed without departing from the gist of the present invention.

The invention claimed is:

1. A selvage yarn shedding apparatus of a loom comprising: two support bodies each having carrier rods configured to support a heddle into which a selvage yarn is inserted and a slide guide having both end portions to which the carrier rods are attached; a drive motor configured to drive in forward and reverse rotations; a support frame fixed to a loom frame and comprising a guide part configured to guide displacement of the slide guides in an upper and lower direction, the drive motor being attached to the support frame; and a motion conversion mechanism configured to connect an output shaft of the drive motor and both the support bodies each other and to convert rotation of the output shaft into reciprocating motion in the upper and lower direction of each support body, wherein each of the support bodies comprises a connecting part including an extension portion provided above the carrier rod and extending from the slide guide in a longitudinal direction of the carrier rod toward a side where the heddle exists, where the connecting part is configured to connect the slide guide and the motion conversion mechanism each other at the extension portion.

2. The selvage yarn shedding apparatus of a loom according to claim 1, wherein each connecting part is connected to the motion conversion mechanism within an existence range of the heddle in the longitudinal direction.

3. The selvage yarn shedding apparatus of a loom according to claim 1, characterized in that each connecting part is formed as a separate body from the slide guide and is detachably attached to the slide guide.

4. The selvage yarn shedding apparatus of a loom according to claim 2, characterized in that each connecting part is formed as a separate body from the slide guide and is detachably attached to the slide guide.

* * * * *